US008920184B2

(12) United States Patent
Murphy et al.

(10) Patent No.: US 8,920,184 B2
(45) Date of Patent: Dec. 30, 2014

(54) HIGH STRENGTH ELECTRICAL CONNECTOR

(75) Inventors: Joseph Murphy, Highland Park, IL (US); Lucas Hartmann, Chicago, IL (US); Randall G. Stone, McHenry, IL (US); Keith Jozwik, Lindenhurst, IL (US)

(73) Assignee: Woodhead Industries, Inc., Lincolnshire, IL (US)

( * ) Notice: Subject to any disclaimer, the term of this patent is extended or adjusted under 35 U.S.C. 154(b) by 64 days.

(21) Appl. No.: 13/383,235

(22) PCT Filed: Jul. 12, 2010

(86) PCT No.: PCT/US2010/041688

§ 371 (c)(1), (2), (4) Date: Mar. 14, 2012

(87) PCT Pub. No.: WO2011/006154

PCT Pub. Date: Jan. 13, 2011

(65) Prior Publication Data

US 2012/0164870 A1 Jun. 28, 2012

Related U.S. Application Data

(60) Provisional application No. 61/224,789, filed on Jul. 10, 2009.

(51) Int. Cl.
*H01R 13/62* (2006.01)

(52) U.S. Cl.
USPC ..... 439/320; 439/585; 439/461

(58) Field of Classification Search
USPC ..... 439/320, 544, 461, 462, 736
See application file for complete search history.

(56) References Cited

U.S. PATENT DOCUMENTS

| | | | | |
|---|---|---|---|---|
| 4,097,106 | A | 6/1978 | Over et al. | |
| 4,181,394 | A | 1/1980 | Dodge | |
| 4,195,899 | A | 4/1980 | Radloff et al. | |
| 4,310,213 | A | 1/1982 | Fetterolf, Sr. et al. | |
| 4,737,124 | A * | 4/1988 | Ezure et al. | 439/607.41 |
| 4,808,123 | A | 2/1989 | Dee et al. | |
| 6,142,805 | A * | 11/2000 | Gray et al. | 439/206 |
| 6,152,753 | A | 11/2000 | Johnson et al. | |
| 6,217,380 | B1 * | 4/2001 | Nelson et al. | 439/578 |
| 6,257,920 | B1 | 7/2001 | Finona et al. | |
| 6,559,383 | B1 * | 5/2003 | Martin | 174/84 R |
| 6,994,579 | B2 * | 2/2006 | Yokoigawa et al. | 439/320 |
| 8,241,053 | B2 * | 8/2012 | Slippy et al. | 439/353 |
| 2006/0144611 | A1 | 7/2006 | Chiu | |

OTHER PUBLICATIONS

International Search Report for PCT/US2010/041688.

* cited by examiner

*Primary Examiner* — Hien Vu
(74) *Attorney, Agent, or Firm* — Clarence R. Moon, III

(57) ABSTRACT

A high strength electrical connector includes an outer cylindrical, rigid support cover open at both ends and preferably comprised of a high strength metal. A first electrical lead extends through a tension bushing attached to one end of the support cover. A mating receptacle through which a second electrical lead passes is securely attached to a second opposed end of the support cover. Electrical connection between the ends of the first and second electrical leads is established within the support cover. Securely attaching the ends of the first and second electrical leads together within the support cover, which is preferably comprised of a high strength metal, directs axial and transverse forces exerted on the first electrical lead through the support cover, thus bypassing the electrical connection.

47 Claims, 13 Drawing Sheets

130
90
90a
100
144
98c
98
98a
144a
108
110
102
104
94
96
88
98b
150
154
152
116a
106

HIGH STRENGTH ELECTRICAL CONNECTOR

BACKGROUND OF THE INVENTION

The widespread use of electrical connectors frequently places them in hostile environments where they are subject to large forces. These forces may be applied either axially along the length of the electrical connector, or transverse to the electrical connector's axis. In either case, the connector is subject to damage and the electrical connection may be interrupted. Interruption of the electrical connection results in at least a loss of power or an interruption in the transmission of data, and may even present a safety hazard.

One prior approach to increasing the integrity of the electrical connection has made use of kevlar. In one example, kevlar is wrapped around part of the electrical connector itself. In another example, kevlar is secured by crimping. Both of these approaches have met with only limited success when large forces are applied because of the difficulty in securely attaching the kevlar. Another example of the use of kevlar for this purpose involves attempts to impregnate a layer of kevlar in the electrical connector's housing. This approach has also met with limited success because of the difficulty in consistently incorporating kevlar in a moldable material such as plastic. Thus, efforts to date have met with only limited success in providing an electrical connector capable of withstanding large axial and/or transverse forces while maintaining the integrity of the electrical connection.

SUMMARY OF THE INVENTION

This invention is directed to a high strength electrical connector for connecting first and second electrical cables, each having one or more electrical conductors or leads. Threadably attached to a first end of a rigid, high strength support cover in the form of a hollow cylinder is a tension bushing. Threadably attached to a second, opposed end of the support cover is a mating receptacle. The first electrical cable extends through the tension bushing, while the second electrical cable terminates in a female connector disposed in the mating receptacle which receives an insert. Disposed on an outer threaded portion of the mating receptacle is a locking nut for securely attaching the high strength electrical connector to a support member such as the panel of electrical equipment housing. An end of the first electrical cable includes a cable jacket crimp and is secured within an overmold portion. Contained within a second opposed end of the overmold is a male contact carrier and a coupling nut. The male contact carrier includes plural male contact pins each connected to a respective conductor of the first electrical cable. The coupling nut, generally a hollow cylinder with external threads, is disposed over the male contact carrier. The overmold, the coupling nut, the male contact carrier, and the end of the first electrical cable are disposed within and aligned along the length of the support cover. The female contacts of the connector in the mating receptacle are adapted for electrical coupling to respective male contact pins in the male contact carrier. In addition, the outer threaded portion of the mating receptacle is adapted for threadably engaging the second end of the support cover in a sealed manner so that the electrical coupling between the first and second connectors is disposed within the support cover. Disposed within and extending the length of the first electrical cable is a cable strength member comprised of high strength stainless steel wire. An end of the cable strength member is securely attached to the combination of an insert shell and the coupling nut which, in turn, is connected to the mating receptacle. The support cover protects and isolates the electrical connection from non-axial forces exerted on the electrical connector. The cable strength member cooperates with the support cover to direct axial forces, such as a pulling force exerted on the first electrical cable, around the electrical connection to the mating receptacle which is securely attached to the electrical connector's support panel, or other support structure.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like-reference characters identify like elements throughout the various figures, in which:

FIG. 4*a* is an end view of the high strength electrical connector shown in

FIG. 4;

DETAILED DESCRIPTION OF THE PREFERRED EMBODIMENTS

Figure 5:
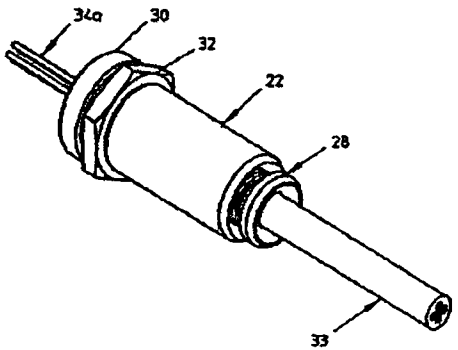
FIG. 5 is a perspective view of the assembled high strength electrical connector of the present invention.
Figure 2:
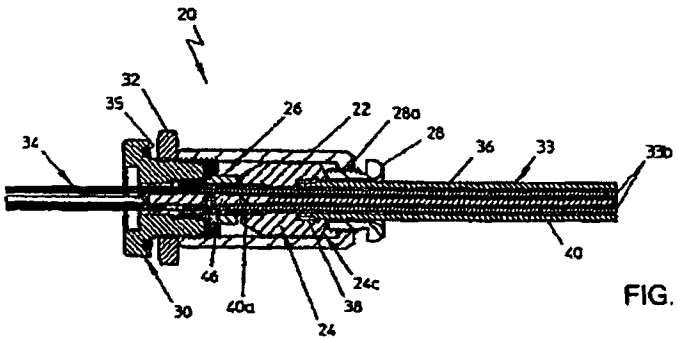
FIG. 2 is a longitudinal sectional view of the high strength electrical connector of FIG. 1.
Figure 1:
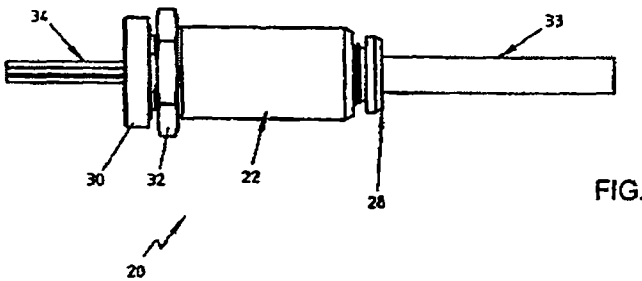
FIG. 1 is a side elevation view of an assembled high strength electrical connector in accordance with the principles of the present invention.
Figure 6:
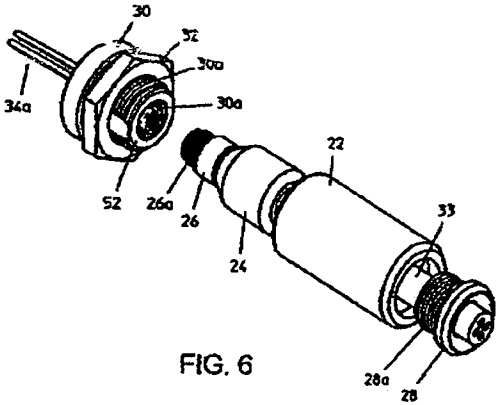
FIGS. 6 and 7 are different perspective views of the inventive high strength electrical connector prior to secure coupling of adjacent components of the electrical connector as in the side elevation and longitudinal sectional views of FIGS. 3 and 4.
Figure 7:
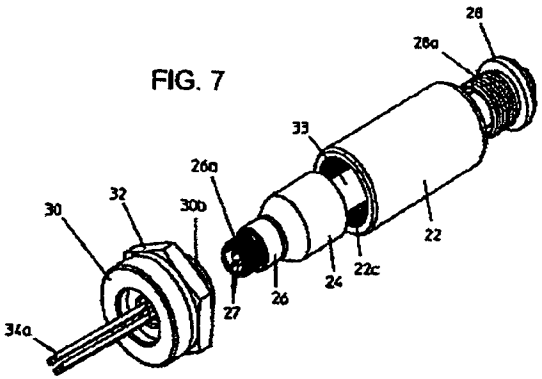
Figure 3:
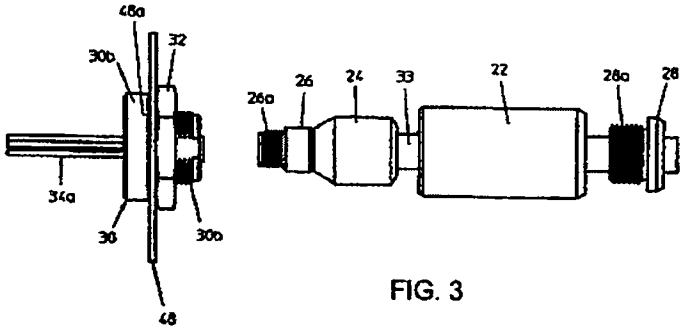
FIG. 3 is a side elevation view of the high strength electrical connector of FIG. 1 showing the various components in alignment prior to coupling of adjacent parts of the electrical connector.
Figure 4:
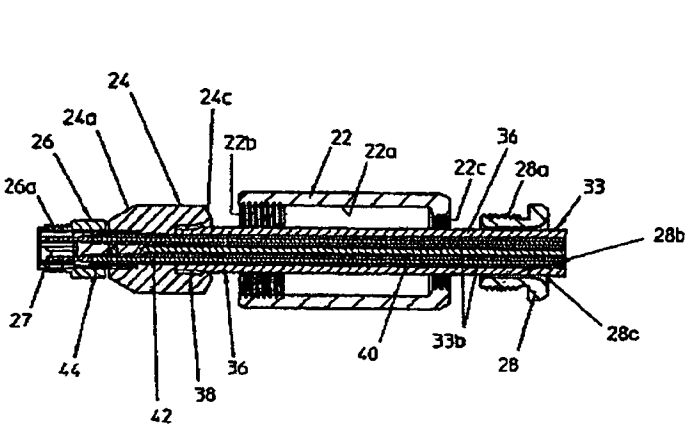
FIG. 4 is a longitudinal sectional view of the arrangement of the high strength electrical connector shown in FIG. 3 prior to secure connection of adjacent components of the electrical connector.
Figure 4A:
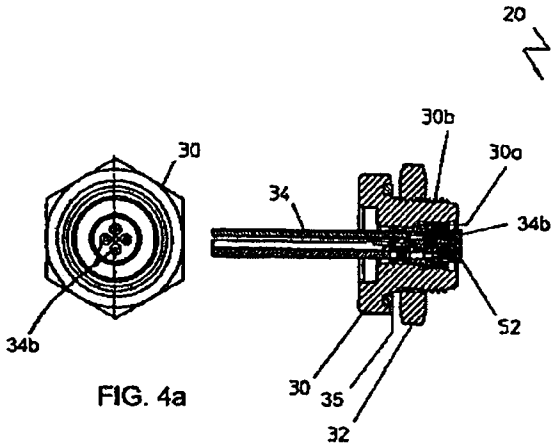
Figure 10:
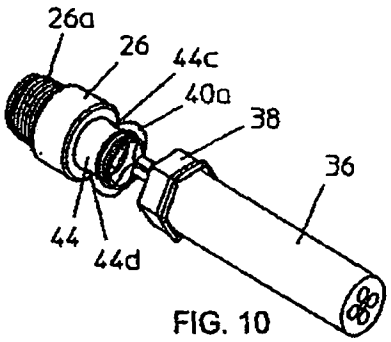
FIGS. 9 and 10 are respectively side elevation and perspective views of the portion of the high strength electrical connector illustrated in FIG. 8.
Figure 9:
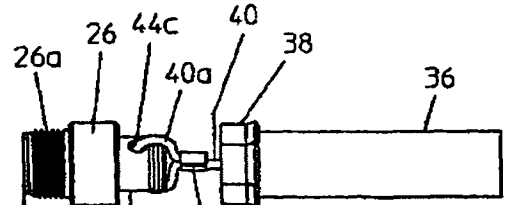
Figure 8:
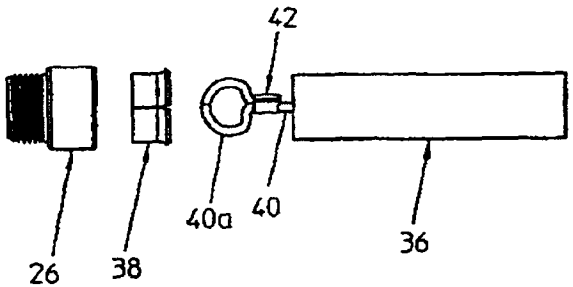
FIG. 8 is an exploded side elevation view of a portion of the high strength electrical connector of the present invention.
Figure 8A:
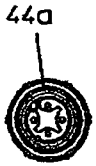
FIG. 8*a* is an end view of the portion of the high strength electrical connector shown in FIG. 8.

Referring first to FIGS. 1 and 2, these are respectively shown side elevation and longitudinal sectional views of an assembled high strength electrical connector 20 in accordance with the present invention. FIGS. 3 and 4 are respectively side elevation and longitudinal sectional views illustrating the inventive high strength electrical connector 20 in a partially assembled configuration. FIG. 4*a* is an end view of the high strength electrical connector 20 shown in FIGS. 3 and 4. FIG. 5 is a perspective view of the assembled inventive high strength electrical connector 20 shown in FIG. 1, while FIGS. 6 and 7 are perspective views of the inventive high strength electrical connector 20 in a partially assembled configuration such as shown in the side elevation view of FIG. 3. FIG. 8 is an exploded side elevation view of a portion of the inventive high strength electrical connector 20. FIG. 8*a* is an end view of the portion of the high strength electrical connector 20 shown in FIG. 8. FIGS. 9 and 10 are respectively side elevation and perspective views of the portion of the high strength electrical connector 20 shown in the exploded side elevation view of FIG. 8. FIGS. 11-16 are longitudinal sectional views of the inventive high strength electrical connector illustrating the direction of an axial force exerted on the connector. Finally, FIGS. 17-20 are longitudinal sectional views of the inventive high strength electrical connector illustrating the direction of a lateral force exerted on the connector generally transverse to its longitudinal axis.

The high strength electrical connector 20 is adapted for connecting first and second multi-conductor electrical cables 33 and 34. Electrical connector 20 includes an elongated, cylindrically shaped support cover 22 preferably comprised of a high strength metal. The interior of support cover 22 defines an inner, elongated cavity 22*a*. Disposed on opposed ends of the support cover 22 are first and second inner threaded portions 22*b* and 22*c*. The first and second inner threaded portions 22*b*, 22*c* of the support cover 22 are linearly aligned and are adapted to respectively receive the second and first electrical cables 34, 33. Electrical cable 33 includes an outer cover, or jacket, 36 and plural inner electrical leads 33*b* extending along the length thereof. Also disposed within the first electrical cable 33 is a cable strength member 40 preferably comprised of stainless steel aircraft cable having a tensile strength of at least 300 pounds.

The first inner threaded portion 22*c* of support cover 22 is adapted to receive and engage the outer threads 28*a* of a tension bushing 28. Tension bushing 28 includes an elongated, linear slot 28*b* having a generally circular cross section extending therethrough which is also adapted to receive the first electrical cable 33. An outer end portion 28*c* of the slot 28*b* through tension bushing 28 is formed in a tapered, curvilinear manner to facilitate bending of the first electrical cable 33 without damaging its outer jacket 36.

The support cover's inner cavity 22*a* through which the first electrical cable 33 extends is adapted to receive an overmold 24. Overmold 24 is generally cylindrical in shape and may include first and second end portions 24*a* and 24*c* which may be tapered. Overmold 24 may be comprised of PBT material which is impregnated with stainless steel fiber, or other moldable, high strength material. Overmold 24 is molded about the first electrical cable 33 in a tight-fitting manner. The first electrical cable's outer jacket 36 is stripped away from the cable and has attached thereto a metal cable jacket crimp 38. The first electrical cable's inner electrical leads 33*b* and its cable strength member 40 extend beyond the end of the first electrical cable extension's outer jacket 36 and through the remaining portion of the slot through overmold 24. Overmold 24 includes a tapered compression surface 24*c* which is engaged by the inner end of the tension bushing 28 when attached to support cover 22 so as to maintain the overmold and other components of the electrical connector in fixed position within the electrical connector's support cover 22.

Attached to the ends of the first electrical cable's inner electrical leads 33*b* are male contact pins 27 which are disposed within a male contact carrier 46. Each of the male contact pins 27 is adapted for connection to a respective one of female contacts 34*b* each connected to a respective one of electrical leads 34*a* of the second electrical cable 34. An outer end surface of the coupling nut 26 is provided with a threaded portion 26*a* for attachment to a mating receptacle 30 as described in detail below.

As shown in FIGS. 8, 9 and 10, coupling nut 26 is adapted to receive an insert shell 44 in its inner, elongated slot extending the length of the coupling nut. Coupling nut 26 and insert shell 44 are comprised of a high strength metal. A first enlarged end 44*a* of insert shell 44 is adapted to engage the threaded end portion 26*a* of coupling nut 26 when the insert shell is inserted through the coupling nut. The insert shell's first enlarged end 44*a* prevents further insertion of the shell through the coupling nut 26 and allows the coupling nut to freely rotate while the insert shell remains stationary. A second, opposed open end 44*b* of insert shell 44 is adapted to receive a male contact carrier 46 in the form of a rigid, electrically insulating, non-conductive material, generally cylindrical and elongated axially, with cavities which are generally cylindrical, for housing a plurality of male contact elements in the form of pins, which provide electrical insulation between the insert shell, the male contacts, and the electrical leads extending therethrough.

Disposed adjacent the open end portion 44*b* of insert shell 44 are a pair of apertures 44*c* and 44*d* as shown in FIG. 10. Aligned apertures 44*c* and 44*d* are adapted to receive an end of cable strength member 40 as shown in FIGS. 9 and 10. An end 40*a* of cable strength member 40 is inserted through the aligned apertures 44*c* and 44*d* and the end of the wire is securely attached to an intermediate portion of the wire by means of a wire crimp 42. Wire crimp 42 is preferably comprised of metal and is formed and attached to cable strength member 40 in a conventional manner.

The outer threaded end portion of 26*a* of coupling nut 26 is adapted for coupling to an inner threaded portion 30*a* of mating receptacle 30. Mating receptacle 30 includes an inner slot extending therethrough which is aligned and continuous with its inner threaded end portion 30*a*. Disposed within the slot of mating receptacle 30 is a multi-socket female contact carrier 52 which is attached to the electrical leads 34*a* of the second electrical cable 34. Each of the female contacts 34*b* within the female contact carrier 52 is adapted to receive and engage a respective male contact pin 27 within male contact carrier 46. It is in this manner that the first electrical cable 33 is electrically coupled to the second electrical cable 34.

Disposed on an outer surface of mating receptacle 30 is a second outer threaded portion 30*b* which is adapted to engage the second inner threaded portion 22*b* of support cover 22. It is in this manner that mating receptacle 30 is securely coupled to the support cover 22. Also, disposed on the mating receptacle's second outer threaded portion 30*b* is a panel lock nut 32 which is adapted to engage a structure to which the high strength electrical connector 20 is mounted. For example, shown in FIG. 3 is panel lock nut 32 engaging a first surface of a panel 48 such as of an electrical equipment housing having an aperture 48*a* through which mating receptacle 30 has been inserted. Disposed in a generally circular recess within the mating receptacle 30 is a panel seal 35 in the preferred form of an O-ring for engaging in a sealed manner a second opposed surface of panel 48. Panel lock nut 32 thus insures secure coupling of the high strength electrical connector 20 to a support structure such as panel 48.

Figure 11:
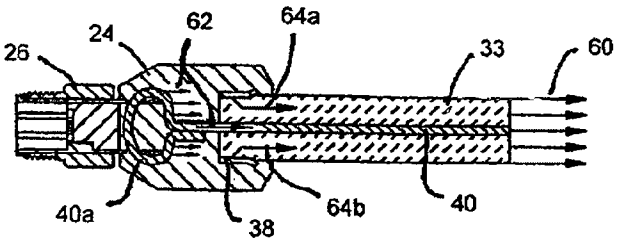
FIGS. 11-16 are longitudinal sectional views of the inventive high strength electrical connector illustrating the manner in which an axial force exerted on the connector is directed around and not through the electrical coupling, but rather through the high strength components of the electrical connector.
Figure 12:
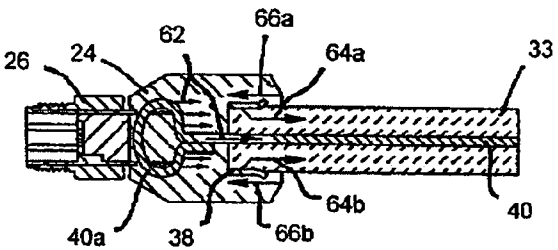
Figure 13:
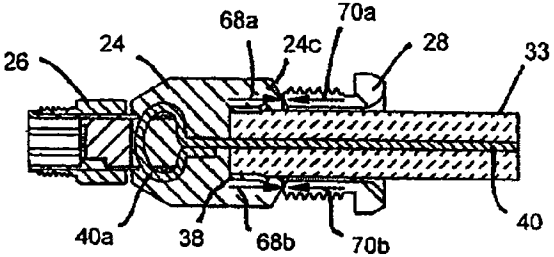
Figure 14:
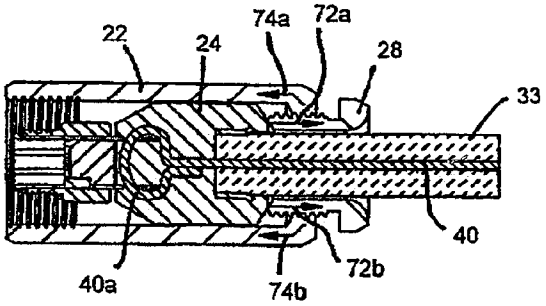
Figure 15:
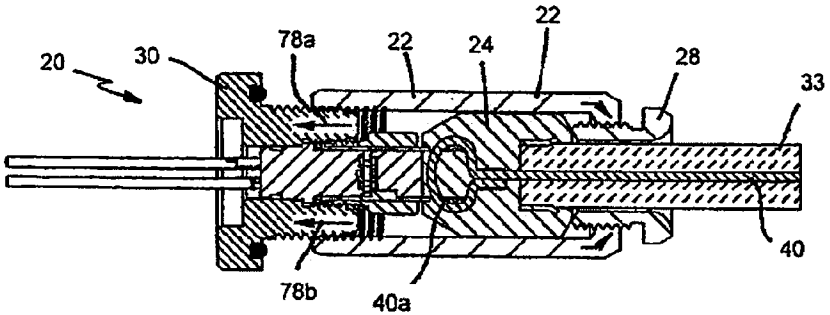
Figure 16:
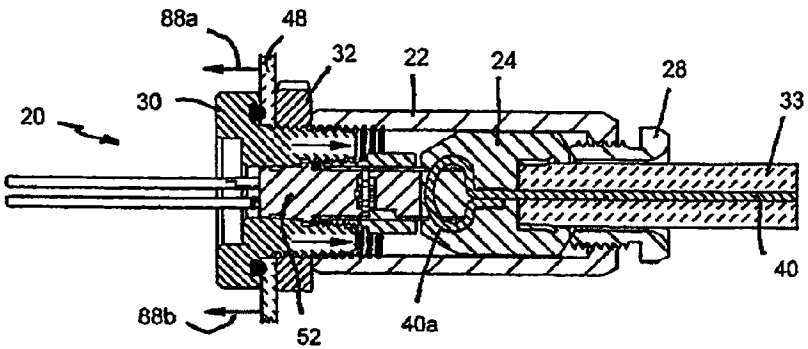

Referring to FIGS. 11-16, there are shown longitudinal sectional views of the high strength electrical conductor 20 of the present invention and various portions of the electrical connector. These figures illustrate the manner in which an axial force exerted on the electrical connector 20 is directed around and not through the electrical coupling, but rather through the high strength components of the inventive electrical connector. Shown in FIGS. 11, 12 and 13 are the electrical connector's coupling nut 26 and overmold 24 connected together, with the overmold further coupled to the first electrical cable 33 containing a cable strength member 40 having an end loop 40*a* in accordance with the present invention. When the cable 33 is subjected to a pull force in the direction of arrows 60, this force is transferred to the cable strength member 40 including its end loop 40*a* as shown by the direction of arrows 62. This pulling force is also transferred to the cable jacket crimp 38 in the direction of arrows 64*a* and 64*b* as shown in FIG. 11. The cable strength member 40 and the cable jacket crimp 38 resist the applied force on the cable 33 by transferring it to the overmold 24 in the direction of arrows 66*a* and 66*b* as shown in FIG. 12. The conductors 33*b* of the first electrical cable 33 (which are not shown in FIGS. 11-16 for simplicity) also resist the force on the first electrical cable 33 by pulling on the overmold 24 in a direction toward the right as shown in these figures. However, this resistance to a pulling force exerted on the first electrical cable conductors 33*b* is not part of the present invention. Overmold 24 resists the force exerted on it by the cable strength member 40 including its end of loop 40*a*, and by the cable jacket crimp 38 by transferring it to the tension bushing 28 as shown by arrows 68*a* and 68*b*. Tension bushing exerts a compressive force in the direction of arrows 70*a* and 70*b* on the compression surface 24*c* of overmold 24 as shown in FIG. 13 and as discussed above.

Tension bushing 28 resists the force exerted upon it from overmold 24 as shown by the direction of arrows 72*a* and 72*b* by transferring this force to support cover 22 as shown by arrows 74*a* and 74*b*. Support cover 22 resists the force applied to it by tension bushing 28 by transferring this force to mating receptacle 30 as shown by arrows 78*a* and 78*b* in FIG. 15. Receptacle shell 30 resists the force applied to it by support cover 22 by transferring this force to panel 48 which is the structure to which the high strength electrical connector 20 is mounted, as shown by arrows 88*a* and 88*b* in FIG. 16.

Figure 17:
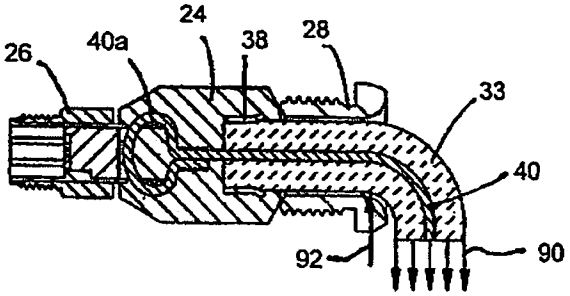
FIGS. 17-20 are longitudinal sectional views of the inventive high strength electrical connector illustrating the direction of a lateral force exerted on the connector generally transverse to its longitudinal axis.
Figure 18:
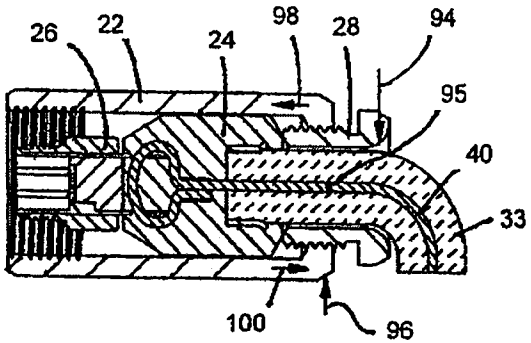
Figure 19:
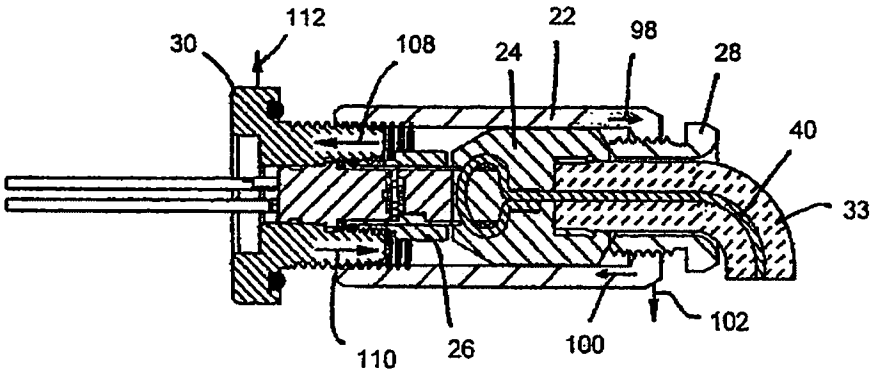
Figure 20:
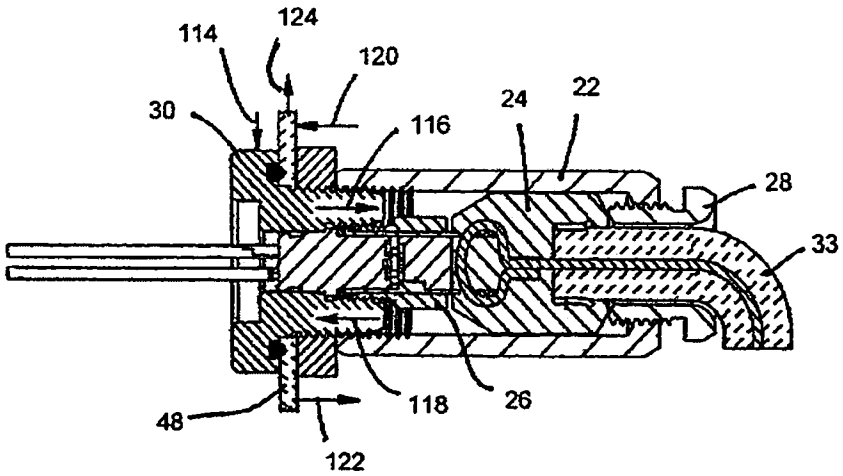

Referring to FIGS. 17-20, there are shown longitudinal sectional views of the inventive high strength electrical connector illustrating the manner in which a lateral pull force exerted on the first electrical cable 33 and directed generally transverse to the longitudinal axis of the connector is directed around the electrical connection and through the high strength components of the electrical connector. The inventive electrical connector is, thus, more resistant to these types of forces for maintaining the electrical connection between a pair of electrical cables. As shown in FIG. 17, the first electrical cable 33 is subjected to a downward pull in the direction of arrows 90. The end of the first electrical conductor 33 to which is attached the cable jacket crimp 38 is securely connected to overmold 24 as described above. The downward pulling force exerted on the first electrical cable 33 is resisted by upwardly directed reaction force 92 exerted on the cable by tension bushing 28. The downward force exerted on tension bushing 28 produces a moment force in the direction of arrow 94 as shown in FIG. 18 about a point of contact between the tension bushing and the adjacent end of the support cover 22 such as shown by point 95. Tension bushing 28 resists the pull force exerted on the first electrical cable 33 and transfers it to the support cover 22 as shown by arrow 98. This force is resisted by the support cover 22 by exerting a reaction force in the direction of arrow 100. Support cover 22 also exerts an upwardly directed reaction force 96 to the downward pull force exerted on the tension bushing 28 by the first electrical cable 33 as also shown in FIG. 18.

Support cover 22 resists the pull force and the moment force exerted on it by the tension bushing 24 and transfers these forces to the mating receptacle 30. The force on the mating receptacle 30 transferred by the support cover 22 is shown as arrow 108, and its reaction to this force is shown as arrow 110 in FIG. 19. An upward reaction force exerted by the mating receptacle 30 in response to the downward force 102 exerted on the support cover 22 is shown by arrow 112. The mating receptacle 30 is attached to panel 48 which provides an upwardly directed reaction force shown by arrow 124 to counteract the downward force exerted on the mating receptacle shown by arrow 114. In addition, moment forces 120 and 122 respectively exerted on and provided by panel 48 counteract moment forces 116 and 118 respectively exerted on and provided by mating receptacle 30.

Figures 21, 22, 23:
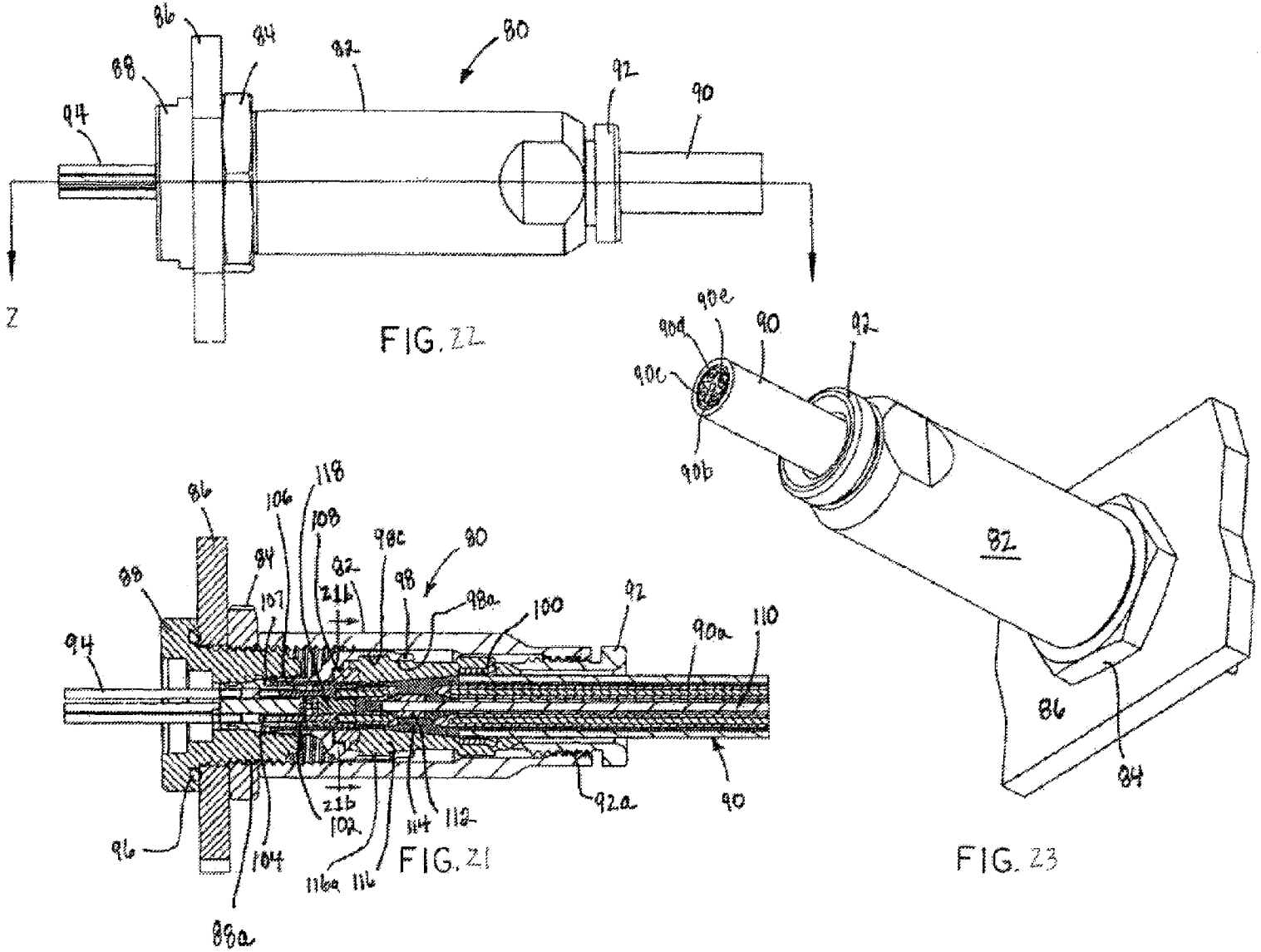
FIG. 21 is a longitudinal sectional view of a high strength electrical connector in accordance with another embodiment of the present invention.
FIG. 22 is a side elevation view of the high strength electrical shown in FIG. 21.
FIG. 23 is a perspective view of the high strength electrical connector shown in FIG. 21.

Referring to FIG. 21, there is shown a longitudinal sectional view of a high strength electrical connector 80 in accordance with another embodiment of the present invention.

Figure 24:
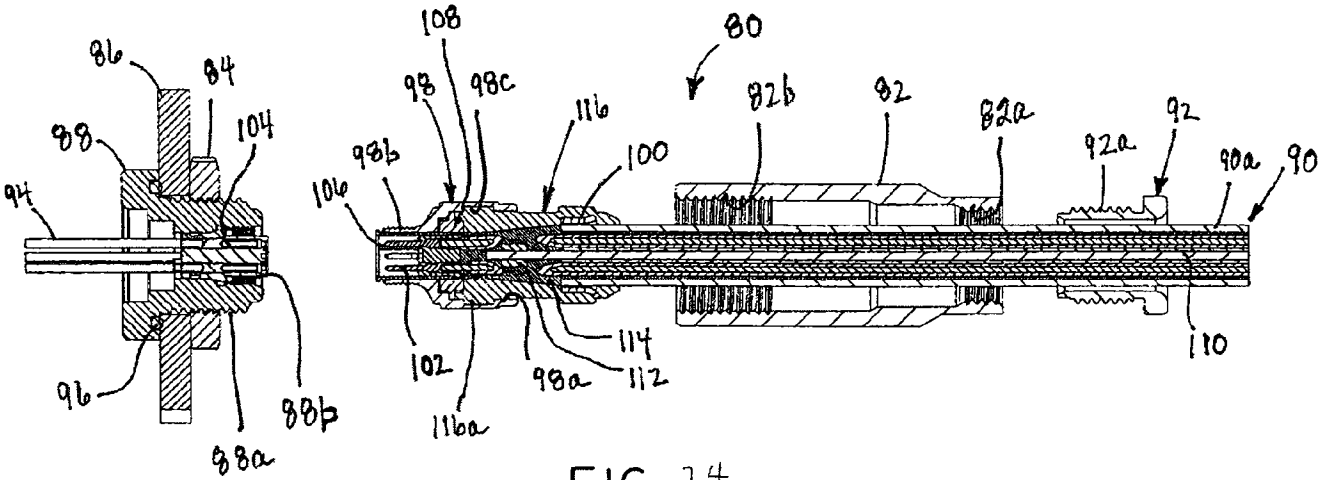
FIG. 24 is a longitudinal sectional view shown partially exploded of the high strength electrical connector shown in FIG. 21.

FIGS. 22 and 23 are respectively side plan and perspective views of the high strength electrical connector 80. FIG. 24 is a longitudinal sectional view of the high strength electrical connector 80 shown with the male and female portions disconnected.

High strength connector 80 electrically connects first and second Ethernet cables 90 and 94 together in a secure manner to withstand a force of up to 300 pounds applied either transverse or parallel to the longitudinal axis of the connector. High strength electrical connector 80 includes a rigid, high strength support cover 82 aligned lengthwise along the axis of the coupled first and second Ethernet cables 90, 94. Support cover 82 is preferably comprised of a high strength material such as steel and includes inner respective threaded portions 82*a* and 82*b* on its opposed ends. The first inner threaded portion 82*a* of the high strength support cover 82 is adapted to receive the outer threaded portion 92*a* of a tension bushing 92 which includes an inner slot extending along its length, which is adapted to receive the first Ethernet cable 90 as in the previously described embodiment. Extending within and along the length of the first Ethernet cable 90 is a high strength member 110 preferably in the form of a stainless steel cable. The second inner threaded end portion 82*b* disposed on the opposite end of the high strength support cover 82 is adapted to receive an outer threaded portion 88*a* of a mating receptacle assembly 88 also as in the previously described embodiment. Mating receptacle assembly 88 includes a center slot extending the length thereof which is adapted to receive the second Ethernet cable 94. The first and second Ethernet cables 90, 94 each include plural spaced electrical conductors, such as conductors 90*b*, 90*c*, 90*d* and 90*e* shown in FIG. 23 for the first Ethernet cable 90. The conductors in the first Ethernet cable 90 terminate in respective male contacts 102, while the electrical conductors in the second Ethernet cable 94 terminate in respective female contacts 104. Each female contact 104 is adapted to receive a respective male contact 102 in electrically connecting the first and second Ethernet cables 90, 94. A lock nut 84 is also disposed on the outer threaded end portion 88*a* of the mating receptacle assembly 88. Disposed between the lock nut 84 and an enlarged end portion of the mating receptacle assembly 88 is a generally planar support panel 86. The high strength electrical connector 80 may be securely attached to support panel 86 by tightening lock nut 84 securely against one surface of the support panel 86, which is then maintained securely in position between the lock nut and the expanded end portion of the mating receptacle assembly 88. An O-ring seal 96 is disposed in an annular recessed portion in the expanded end portion of the mating receptacle assembly 88 and is positioned in contact with support panel 86 to provide a water tight seal between the support panel and the mating receptacle assembly. The components of the high strength electrical connector 80 described thus far are similar in configuration and function to the corresponding components of the embodiments described above in terms of FIGS. 1-20.

The following components are unique to the high strength electrical connector 80 embodiment shown in FIGS. 21-24. These components include a coupling nut 98, inner and outer overmolds 114, 116, and an anti-vibration collar 108. Coupling nut 98 includes an inner annular recessed portion 98*a* on a first end thereof, and an outer threaded portion 98*b* on its opposed end. The outer threaded end portion 98*b* of coupling nut 98 is adapted for insertion in and coupling to an inner threaded end portion 88*b* of the mating receptacle assemble 88 in securely connecting the coupling nut to the mating receptacle assembly. Coupling nut 98 also includes an elongated center aperture extended therethrough through which the combination of the inner male contacts 102 and an insert shell 106 are inserted. Electrical contact between the male contacts 102 and the female contacts 104 is established when each male contact is inserted into a respective female contact and secure coupling is established between the mating receptacle assembly 88 and coupling nut 88 via the respective inner threaded portion 88*b* of the mating receptacle assembly and the outer threaded end portion 98*b* of the coupling nut.

Disposed within the inner recessed end portion 98*a* of coupling nut 98 is an anti-vibration collar 108 and the combination of an inner overmold 114 and an outer overmold 116. Anti-vibration collar 108 allows coupling nut 98 to be freely rotated in a first direction in threadably connecting the coupling nut to the mating receptacle assembly 88, while rotation of the coupling nut in a second, opposed direction is inhibited by the anti-vibration collar for preventing unwanted disconnection between the coupling nut and mating receptacle assembly. Disposed about and in contact with the electrical conductors extending from the first Ethernet cable 90 and the end of the cable strength number 110 is an inner overmold 114. Also disposed within the inner overmold 114 is a cable retainer 112 attached to the end of the cable strength member 110. Embedding the end of cable strength member 110, and in particular its cable retainer 112, within inner overmold 114 increases the strength of electrical connector 80 to resist axial and transverse forces applied to the electrical connector 80 as well as to the first and second Ethernet cables 90, 94. Inner overmold 114 is preferably comprised of a high strength insulating material such as PBT. Outer overmold 116 is preferably comprised of a high strength conductive material such as PBT impregnated with steel fibers which offers the advantages of high strength and EMI shielding.

Disposed about and in contact with inner overmold 114 is outer overmold 116. A first end of the outer overmold 116 engages and maintains anti-vibration collar 108 in fixed position within the inner recessed end portion 98*a* of coupling nut 98. A second, opposed end of outer overmold 116 is disposed about and in contact with the cable jacket crimp 110 attached to the outer jacket 90*a* of the first Ethernet cable 90 for further increasing the strength of the electrical connector 80. Outer overmold 116 includes an outer annular extended portion 116*a* which is disposed in a complementary annular recessed portion 98*c* within the inner recessed end portion 98*a* of coupling nut 98. This complementary inter-engagement between the outer overmold 116 and the inner surface of coupling nut 98 prevents the outer overmold and inner overmold 114 combination from being removed from the coupling nut. This arrangement also eliminates the need for a retaining ring and the additional assembly associated therewith characteristic of prior approaches. This arrangement also eliminates the requirement for forming a grove in the outer surface of the overmold which weakens the overmold and provides a full flange for improved sealing at the front of the insert shell 106, while allowing for the use of an inflexible metal insert shell with its increased EMI shielding and strength. In addition, by injecting the outer overmold 116 material into the inner recessed end portion 98*a* of coupling nut 98, the overmold material assumes the shape of a negative impression of the inner surface of the coupling nut 98, including the annular recessed portion 98*c* therein. During the curing process of the outer overmold 116, the outer overmold material shrinks in size so as to form a small gap between the outer surface of the outer overmold and the inner surface of the coupling nut 98. This small gap allows the combination of the outer overmold 116, inner overmold 114 and the first Ethernet cable 90 imbedded therein to freely rotate within the coupling nut 98 while maintaining secure retention of the outer overmold within the coupling nut so as to prevent disconnection and removal of the first Ethernet cable. This free rotation feature allows the coupling nut 98 to be rotatably connected to or disconnected from mating receptacle assemble 88 in establishing electrical connection or breaking connection between the first and second Ethernet cables 90, 94 without rotating one cable relative to the other during connection or disconnection.

Figure 25:
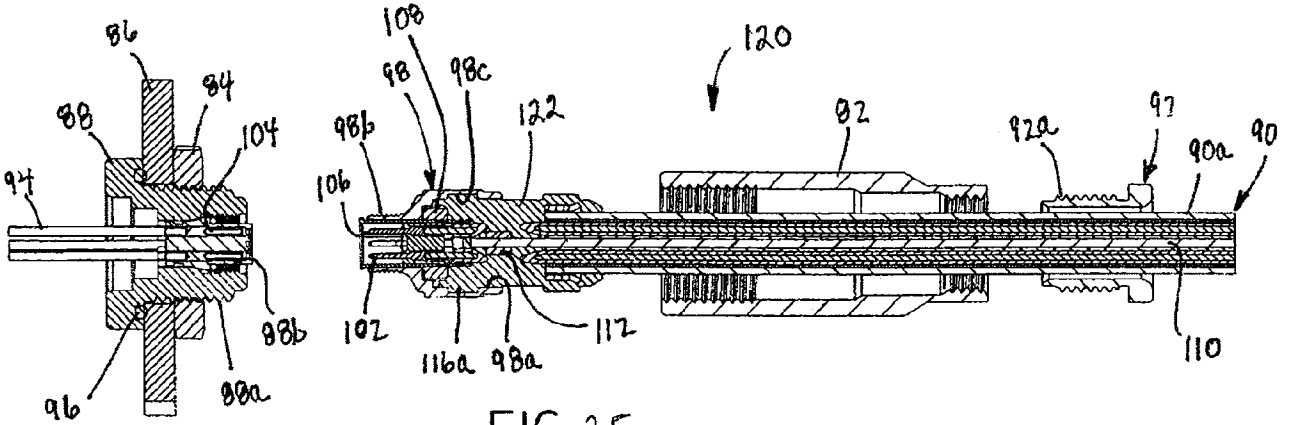
FIG. 25 is a longitudinal sectional view shown partially exploded of a high strength electrical connector in accordance with another embodiment of the present invention.

Referring to FIG. 25, there is shown a longitudinal sectional view of another embodiment of a high strength electrical connector 120 in accordance with the principles of the present invention. The high strength electrical connector 120 is similar to the high strength electrical connector 80 shown in FIGS. 21-24. Thus, components common to these two electrical connectors are provided with the same element numbers in FIGS. 21-24 and in FIG. 25. The difference between high strength electrical connector 120 shown in FIG. 25 and high strength electrical connector 80 shown in FIGS. 21-24 is in the former's use of a single overmold 122 as opposed to the inner and outer overmolds 114, 116 of high speed electrical connector 80.

Overmold 122 is injected into the inner recessed end portion 98*a* of coupling nut 90 and extends out of inner recessed end portion of the coupling nut. A first end portion of overmold 122 engages and maintains anti-vibration collar 108 in position within inner recessed end portion 98*a* of coupling nut 98. An opposed end of the overmold 122 is disposed about and engages cable jacket crimp 100 disposed on and engaging the outer jacket 90*a* of the first Ethernet cable 90. Overmold 122 also is disposed about the end portion of cable strength member 110 and the cable retainer 112 attached thereto for securely maintaining the first and second Ethernet cables 90, 94 coupled electrically to one another when connected together. Finally, overmold 122 is disposed about and maintains electrical conductors extending from the first Ethernet cable 90 in fixed position relative to one another to maintain electrical integrity of the connector and facilitate electrical coupling of the first and second Ethernet cables 90, 94. As in the previously described embodiment, overmold 122 is freely rotatable within the coupling nut 98 to facilitate threaded coupling of the first and second Ethernet cables 90, 94.

Figures 26, 27, 28:
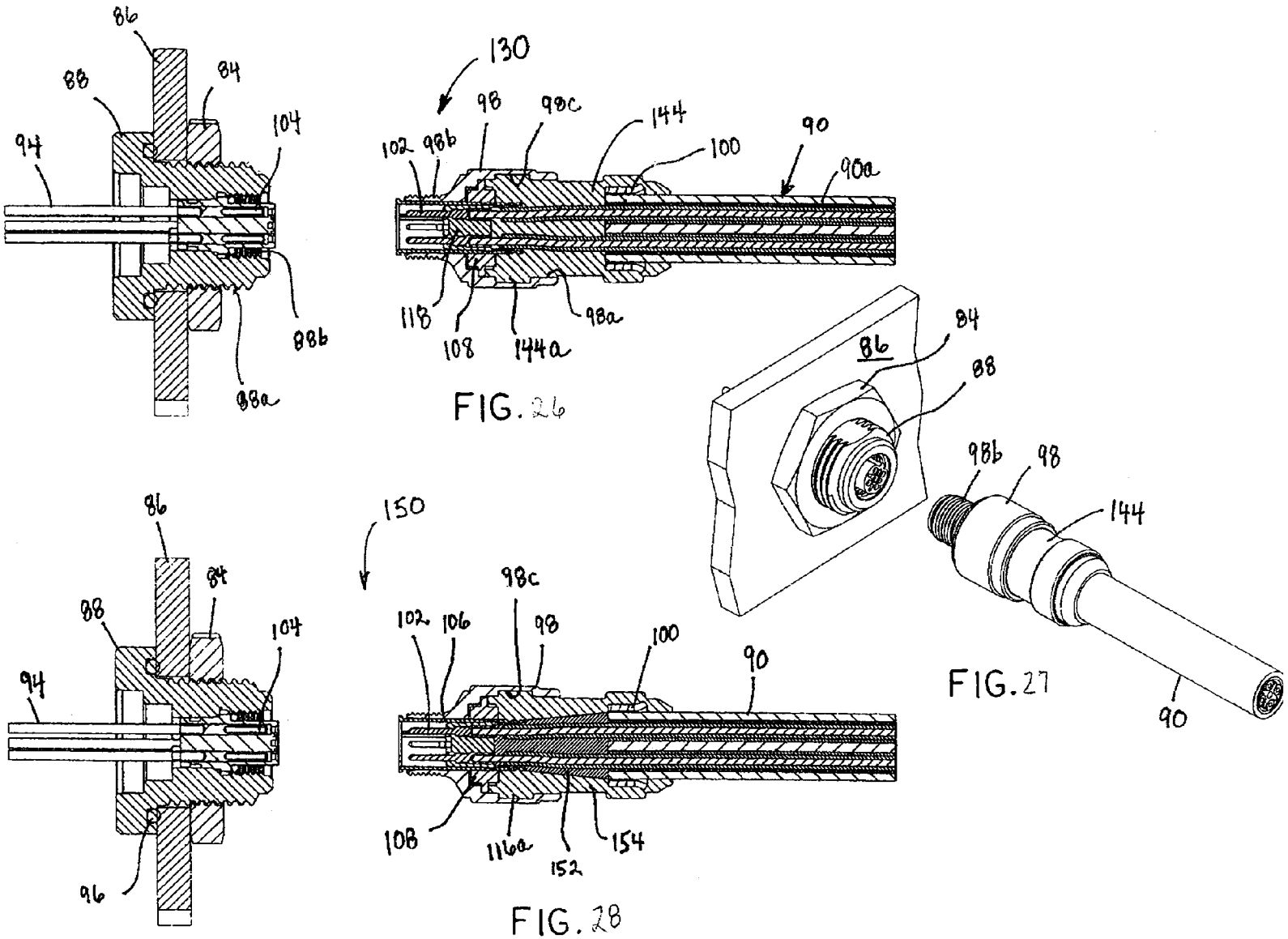
FIG. 26 is a longitudinal sectional view of a high strength electrical connector in accordance with another embodiment of the present invention, where the two connector halves are shown disconnected.
FIG. 27 is a perspective view of the high strength electrical connector shown in FIG. 26.
FIG. 28 is a longitudinal sectional view of a high strength electrical connector in accordance with another embodiment of the present invention where the connector halves are shown disconnected.

Referring to FIGS. 26 and 27, there are respectively shown longitudinal sectional and perspective views of another embodiment of a high strength electrical connector 130 in accordance with the present invention. This embodiment of the present invention is capable of withstanding a 100 pound force applied to the connector either axially or transverse to the longitudinal axis of the connector. The embodiment of the high strength electrical connector 130 shown in FIG. 26 is similar to the high strength electrical connector 120 shown in FIG. 25, except that the former high strength electrical connector shown in FIG. 26 does not include the rigid, high strength support cover 82 incorporated in the high strength electrical connector 120 shown in FIG. 25. Components of the high strength electrical connector 130 similar in configuration and performing the same function as corresponding components in the high speed electrical connector 120 shown in FIG. 25 are given the same element identifying number as in the previously described embodiment.

Thus, inserted through an elongated slot in mating receptacle assembly 88 is a second Ethernet cable 94. Attached to an outer threaded surface 88*a* of the mating receptacle assembly 88 is a lock nut 84. Disposed about the circumference of the mating receptacle assembly 88 and between an enlarged end portion of the mating receptacle assembly and lock nut 84 is a support panel 86 as in the previously described embodiment. One end of mating receptacle assembly 88 is provided with an inner threaded portion 88*b* which is adapted for coupling to an outer threaded portion 98*b* of a coupling nut 98. Extending through a slot in the coupling nut 88 are plural male contacts 102, each adapted for insertion in a corresponding respective female contact 104 disposed within the mating receptacle assembly 88. Disposed within the coupling nut 98 is the anti-vibration collar 108 described above. Also disposed within the coupling nut 98 and engaging the male contacts 102 is a male contact carrier 118. Disposed within the inner recessed end portion 98*a* of coupling nut 98 is overmold 144 which includes an outer annular extended portion 144*a* disposed within an outwardly extending annular portion 98*c* of the inner recessed end portion of coupling nut as in the previously described embodiment. A first end portion of overmold 144 engages and maintains anti-vibration collar 108 in position within the coupling nut 98. A second, opposed end of overmold 144 is disposed about and engages cable jacket crimp 100 disposed on the outer jacket 90*a* of the first Ethernet cable 90.

Referring to FIG. 28, there is shown yet another embodiment of the present invention similar to that shown in FIG. 26 in that neither embodiment includes a rigid, high strength support cover as in the embodiments shown in FIGS. 1-25. Corresponding elements in the high strength connector 150 shown in FIG. 27 are given element identifying numbers as the corresponding components in the high strength electrical connector 130 shown in FIG. 26. The difference between the embodiments shown in FIGS. 26 and 28 is that the latter embodiment includes inner and outer overmolds 152 and 154 rather than the single overmold 144 shown in FIG. 26.

Figure 21B:
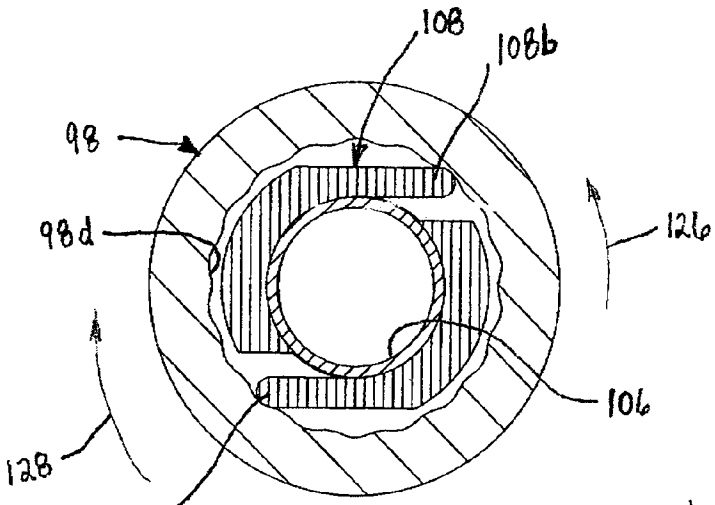
FIG. 21*b* is a sectional view of the high strength electrical connector shown in FIG. 21 taken along site line 21*b*-21*b* in FIG. 21.
Figure 21C:
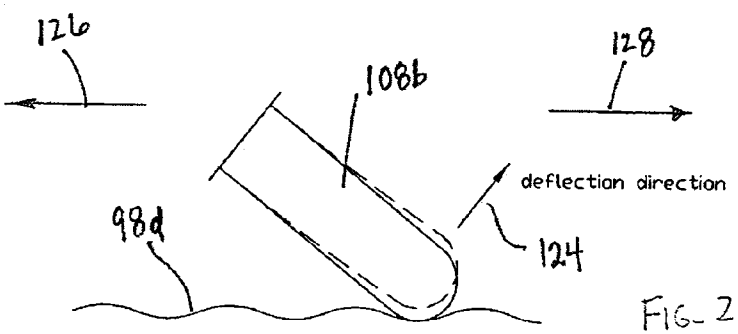
FIG. 21*c* illustrates a portion of the anti-vibration column shown in the sectional view of FIG. 21*b* engaging an inner undulating cam surface in accordance with one aspect of the present invention.
Figure 21A:
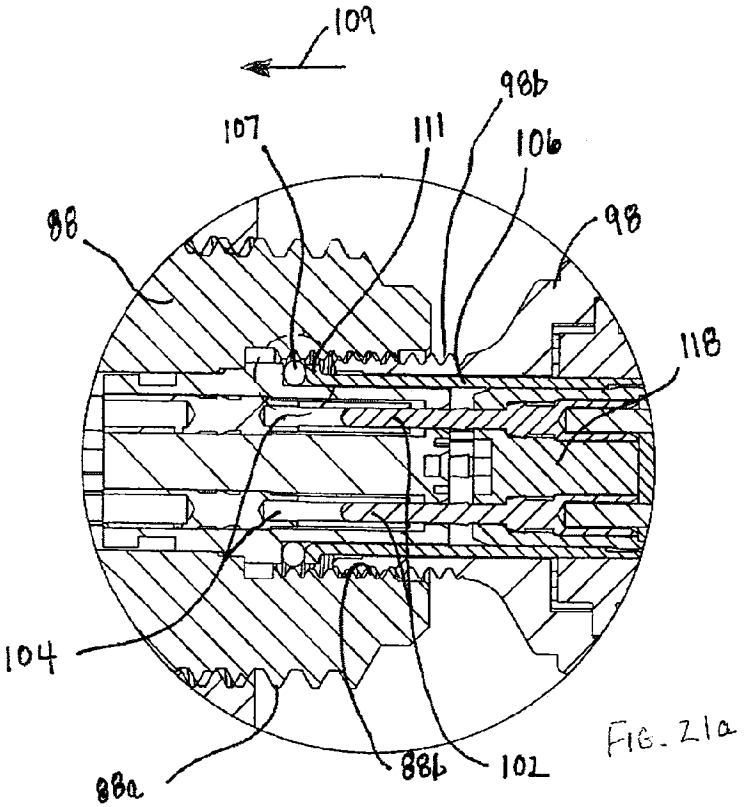
FIG. 21*a* is an enlarged portion of the sectional view of FIG. 21 illustrating additional details of the invention.

Referring to FIG. 21*a*, there is shown an enlarged partial sectional view of a portion of the high speed electrical connector 80 shown in FIG. 21. As described above, the outer threaded end portion 98*b* of coupling nut 98 is connected to the inner threaded portion 88*b* of mating receptacle assembly 88. Similarly, each of plural female contacts 104 is shown connected to a respective male contact 102. As the coupling nut 98 is threadably tightened on the mating receptacle assembly 88, insert shell 106 is urged leftward in the direction of arrow 109 and into contact with O-ring 107. This compresses O-ring in a direction along the longitudinal axis of the high strength electrical connector such that the cross sectional shape of the O-ring becomes elongated in a vertical direction as shown in FIG. 21*a*. This is made possible by the increased space provided in the vertical direction by a generally circular flange 111 formed in the end portion of insert shell 106. Prior approaches in these types of electrical connectors limited expansion of O-ring 107 in a vertical direction, thus resulting in improper compression of the O-ring in attempting to provide a water-tight seal. The additional vertical expansion space provided for O-ring 107 via flange 111 provides an improved water-tight seal in the high strength electrical connector of the present invention.

Referring to FIG. 21*b*, there is shown a sectional view of the high strength electrical connector 80 shown in FIG. 21 taken along site line 21*b*-21*b* in the figure. The sectional view of FIG. 21*b* illustrates details of the anti-vibration collar 108 incorporated in the high strength electrical connector 80. As described above, coupling nut 98 includes an inner undulating cam surface 98*d* which is engaged by the anti-vibration collar 108. Anti-vibration collar 108 is disposed about and engages the insert shell 106 through which the male contacts and the male contact carrier 118 are inserted. Anti-vibration collar 108 further includes first and second outer, resilient deflecting arms 108*b* and 108*c*. The distal ends of each of the first and second deflection arms 108*b*, 108*c* engage the coupling nut's inner undulating cam surface 98*d*. When coupling nut 98 is rotated relative to the anti-vibration collar 108 about the electrical connector's longitudinal axis clockwise in the direction of arrow 128, as in tightening of the threaded connection between the two connector halves, the first and second deflecting arms 108*b*, 108*c* are easily deflected inwardly by the undulations of the cam surface 98*d*. However, when the anti-vibration collar 108 is rotated counterclockwise in the direction of arrow 126 as in loosening/disconnecting the two connector halves, the two deflecting arms 108*b*, 108*c* are deflected with greater difficulty by the undulations in cam surface 98*d*. Thus, the anti-vibration collar 108 allows for easily rotating coupling nut 98 relative to the remaining portion of the connector half in which it is located in coupling the two connector halves together, while retarding relative rotation of the coupling nut in the opposite direction in disconnecting, or releasing, the two connector halves from one another. This provides protection against disconnection of the two connector halves as a result of high vibration conditions.

The manner in which the first and second deflecting arms 108*b*, 108*c* are deflected by the coupling nut's inner undulating cam surface 98*d* is shown in greater detail in FIG. 21*c*. For illustrative purposes, the coupling nut's inner undulating cam surface 98*d* is shown as being generally linear in FIG. 21*c*, although the following description applies equally as well to the actual shape of the undulating surface which is generally circular. As shown in FIG. 21*c*, the upraised portions of inner undulating cam surface 98 deflect the resilient deflecting arm 108*b* in the direction of arrow 124 when there is relative motion between the cam surface and deflecting arm. Because of the orientation of the deflection arm 108*b* relative to the inner undulating cam surface 98*d*, there is a ratcheting action between the deflecting arm and the undulating surface. When the deflecting arm 108*b* is deflected in the direction of arrow 126 corresponding to counterclockwise rotation between the two connector halves, more deflection force is directed along the longitudinal axis of the deflecting arm rendering relative motion between the deflecting arm and the undulating surface more difficult. On the other hand, when the relative motion between the deflecting arm 108*b* and the inner undulating cam surface 98*d* is in the direction of arrow 128 corresponding to clockwise rotation between the two connector halves, more of the deflection force is directed transversely to the longitudinal axis of the deflecting arm 108*b*, or in the direction of arrow 124, facilitating relative motion between the deflecting arm and the inner undulating cam surface.

Figure 30:
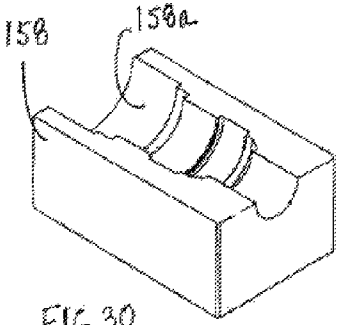
FIG. 30 is an upper perspective view of the lower half tooling member.
Figure 29:
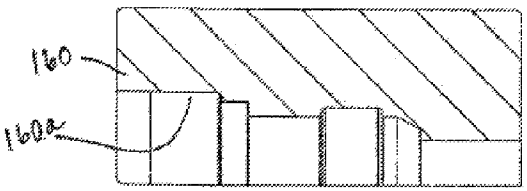
FIG. 29 is a sectional view of tooling which includes lower and upper half tooling members used in injecting the overmold used in the high strength electrical connector of the present invention.
Figure 29:
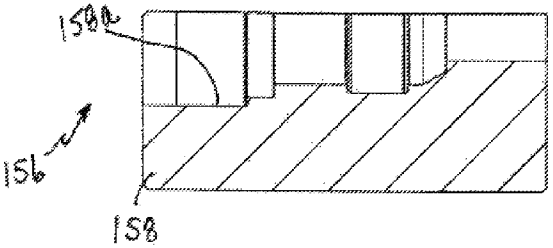
Figure 31:
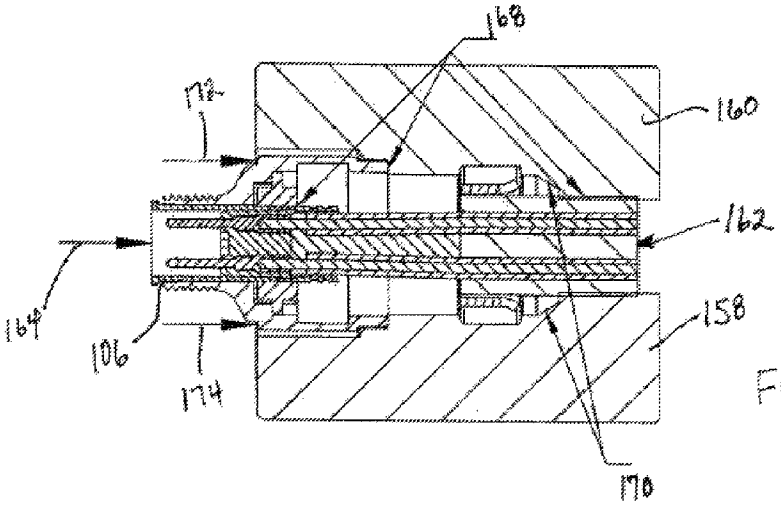
FIG. 31 is a longitudinal sectional view of a high strength electrical connector disposed within the tooling shown in FIG. 30 during assembly of the high strength electrical connector.

Referring to FIG. 29, there is shown a sectional view of tooling 156 for forming the connector's overmold described above. Tooling 156 includes a lower half tooling 158 and an upper half tooling 160. Lower half tooling 158 includes an inner lower pattern 158*a*, while upper half tooling 160 includes a corresponding inner upper pattern 160*a*. A perspective view of lower half tooling 158 containing inner pattern 158*a* is shown in FIG. 30. A partially assembled high strength electrical connector 162 (minus overmold) is positioned between the lower half tooling 158 and the upper half tooling 160 and within the respective inner patterns 158*a*, 160*a* of each as shown in FIG. 31 for injecting the overmold into the assembled connector. Areas 170 indicate where the mold material is injected into the tooling 156 for proper positioning of the overmold within the high strength electrical connector 162. Areas 168 indicate where mold material flow is permitted and then terminated, or shut off, during formation of the overmold within the high strength electrical connector 162. During injection of the overmold in the high strength electrical connector 162, force is applied in the direction of arrows 172 and 174 on the high strength electrical connector 162 for proper termination, or shutting off, of the flow of overmold within tooling 156. Force is also applied in the direction of arrow 164 on the insert shell 106 to ensure that it remains in an axially fixed position during injection of the overmold.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustrated only and not as a limitation. The actual scope of the invention is intended to be defined in the following claims when viewed in their proper perspective based on the prior art.

What is claimed is:

1. A high strength electrical connector comprising:

a first electrical cable carrying a plurality of first electrical leads, said first electrical cable having an outer jacket stripped away from the cable and having a metal cable jacket crimp securing the end of the outer jacket to the cable;

a second electrical cable carrying a plurality of second electrical leads;

said first electrical cable including a cable strength member having a connecting end portion extending beyond the end of the outer jacket and the metal cable jacket crimp;

an overmold portion covering said connecting end portion of said cable strength member and said metal cable jacket crimp;

a mating receptacle assembly retaining said second electrical cable and coupled to the connecting end portion of said first electrical cable for electrical connection of said plurality of second electrical leads with said plurality of first electrical leads of said first electrical cable, a shell member connected to the overmold portion for receiving said cable strength member; wherein said connection end portion of said strength member comprises an inner wire which is connected to an insert shell of the electrical connector; wherein said insert shell has aligned apertures and the connecting end portion of said cable strength member includes a loop extending through said aligned apertures and a wire crimp connecting an end of the wire to an intermediate portion of said wire;

a support cover surrounding said metal cable jacket crimp, said overmold portion and said connecting end portion of said cable strength member, said support cover having a first end connected to said mating receptacle assembly and having a second opposite end; and a bushing surrounding said first electrical cable and connected to said opposite end of said support cover.

2. A high strength electrical connector as recited in claim 1, wherein said cable strength member comprises a steel cable.

3. A high strength electrical connector as recited in claim 2, wherein said steel cable is a stainless steel aircraft cable.

4. A high strength electrical connector as recited in claim 3, wherein said stainless steel aircraft cable has a tensile strength of at least 300 pounds.

5. A high strength electrical connector as recited in claim 1, wherein said overmold portion is comprised of a PBT material impregnated with stainless steel fiber.

6. A high strength electrical connector as recited in claim 1, wherein said cable jacket crimp includes a flared end portion on the side opposite from the end of the outer jacket, said flared end portion covered by and extending outward into said overmold portion.

7. A high strength electrical connector as recited in claim 1, wherein said support cover is threadingly connected to said mating receptacle assembly at said first end and threadingly connected to said bushing at said second opposite end.

8. A high strength electrical connector as recited in claim 1, wherein a coupling nut threadably attached to an outer portion of said mating receptacle assembly.

9. A high strength electrical connector as recited in claim 8, wherein said coupling nut is a panel lock nut adapted for securely attaching the high strength electrical connector to a support panel.

10. A high strength electrical connector as recited in claim 9, wherein said support panel forms a portion of an electrical equipment housing.

11. A high strength electrical connector as recited in claim 1, wherein said overmold portion includes a tapered compression surface engaging an inner end portion of said bushing.

12. A high strength electrical connector comprising:

a first electrical cable carrying a plurality of first electrical leads, said first electrical cable having an outer jacket stripped away from the cable and having a metal cable jacket crimp securing the end of the outer jacket to the cable;

a second electrical cable carrying a plurality of second electrical leads;

said first electrical cable carrying a cable strength member having a connecting end portion extending beyond the end of the outer jacket and the surrounding metal cable jacket crimp;

a mating receptacle assembly retaining said second electrical cable for electrical connection of said plurality of second electrical leads with said plurality of first electrical leads of said first electrical cable;

a coupling nut having a first end connected to said mating receptacle assembly and a second opposed inner recessed end portion;

an overmold portion disposed within and engaging the second inner recessed portion of said coupling nut and covering said connecting end portion of said cable strength member, the ends of said first electrical leads and said metal cable jacket crimp; wherein said overmold portion comprises:

an inner nonconductive overmold portion disposed within the second inner recessed portion of said coupling nut and covering said connecting end portion of said cable strength member and the ends of said first electrical leads; and an outer conductive overmold portion disposed within an engaged the second inner recessed end portion of said coupling nut and covering said inner overmold portion and said metal cable jacket crimp;

a support cover surrounding said metal cable jacket crimp, said overmold portion and said connecting end portion of said cable strength member;

said support cover having a first end connected to said mating receptacle assembly and having an opposite end; and a bushing surrounding said first electrical cable and connected to said opposite end of said support cover.

13. The high strength electrical connector of claim 12, wherein said overmold portion is comprised of a PBT material.

14. The high strength electrical connector of claim 12, wherein said overmold portion is comprised of a PBT material impregnated with steel fibers.

15. The high strength electrical connector of claim 12, wherein said the connecting end portion of said cable strength member includes an enlarged retaining member disposed within the said overmold portion and securely attached to said cable strength member.

16. The high strength electrical connector of claim 12, wherein said second inner recessed end portion of said coupling nut includes a radially expanded portion adapted to receive said overmold portion for preventing axial movement of said overmold portion within said coupling nut for more securely connecting said first and second electrical cables.

17. The high strength electrical connector of claim 16, wherein said radially expanded portion is in the form of an annular ring disposed about said second opposed inner recessed end portion.

18. The high strength electrical connector of claim 12, wherein said overmold portion includes a smooth outer surface engaging the second opposed inner end portion of said coupling nut for allowing said coupling nut to freely rotate on said overmold portion.

19. The high strength electrical connector of claim 12, wherein said overmold portion is comprised of a PBT material.

20. The high strength electrical connector of claim 12, wherein said overmold portion is comprised of a PBT material impregnated with steel fibers.

21. The high strength electrical connector of claim 12, wherein said the connecting end portion of said cable strength member includes an enlarged retaining member disposed within the said inner overmold portion and securely attached to said cable strength member.

22. The high strength electrical connector of claim 12, wherein said second inner recessed end portion of said coupling nut includes a radially expanded portion adapted to receive said overmold portion for preventing axial movement of said overmold portion within said coupling nut for more securely connecting said first and second electrical cables.

23. The high strength electrical connector of claim 22, wherein said radially expanded portion is in the form of an annular ring disposed about said second opposed inner recessed end portion.

24. The high strength electrical connector of claim 12, wherein said overmold portion includes a smooth outer surface engaging the second opposed inner end portion of said coupling nut for allowing said coupling nut to freely rotate on said overmold portion.

25. The high strength electrical connector of claim 12, further comprising:

an anti-vibration member disposed between and engaging said overmold portion and the second opposed inner end portion of said coupling nut for allowing rotation of said mating receptacle assembly on said coupling nut in a first direction for connecting said first and second electrical leads, while inhibiting rotation between said mating receptacle assembly and said coupling nut in a second opposed direction in disconnecting said first and second electrical leads.

26. A high strength electrical connector comprising:

a first electrical cable carrying a plurality of first electrical leads, said first electrical cable having an outer jacket stripped away from the cable and having a metal cable jacket crimp securing the end of the outer jacket to the cable;

a second electrical cable carrying a plurality of second electrical leads;

said first electrical cable carrying a cable strength member having a connecting end portion extending beyond the end of the outer jacket and the surrounding metal cable jacket crimp;

a mating receptacle assembly retaining said second electrical cable for electrical connection of said plurality of second electrical lead with said plurality of first electrical leads of said first electrical cable;

a coupling nut having a first end portion threadably connected to said mating receptacle assembly for releasably connecting said first and second electrical leads, said coupling nut further including a second opposed inner recessed end portion;

an overmold portion disposed within and engaging the second opposed inner end portion of said coupling nut and covering the connecting end portion of said cable strength member, said metal cable jacket crimp and the ends of said first electrical leads; wherein said overmold portion comprises;

an inner nonconductive overmold portion disposed within the second inner recessed portion of said coupling nut and covering said connecting end portion end portion said cable strength member and ends of said ends of said first electrical leads; and an outer conductive overmold portion disposed within and engaging the second inner recessed end portion of said coupling nut and covering said inner overmold portion and said metal metal cable jacket crimp.

27. The high strength electrical connector of claim 26, wherein said overmold portion is comprised of a PBT material.

28. The high strength electrical connector of claim 26, wherein said overmold portion is comprised of a PBT material impregnated with steel fibers.

29. The high strength electrical connector of claim 26, wherein said the connecting end portion of said cable strength member includes an enlarged retaining member disposed within the said overmold portion and securely attached to said cable strength member.

30. The high strength electrical connector of claim 26, wherein said second inner recessed end portion of said coupling nut includes a radially expanded portion adapted to receive said overmold portion for preventing axial movement of said overmold portion within said coupling nut for more securely connecting said first and second electrical cables.

31. The high strength electrical connector of claim 30, wherein said radially expanded portion is in the form of an annular ring disposed about said second opposed inner recessed end portion.

32. The high strength electrical connector of claim 26, wherein said overmold portion includes a smooth outer surface engaging the second opposed inner end portion of said coupling nut for allowing said coupling nut to freely rotate on said overmold portion.

33. The high strength electrical connector of claim 26, wherein said overmold portion is comprised of a PBT material.

34. The high strength electrical connector of claim 26, wherein said overmold portion is comprised of a PBT material impregnated with steel fibers.

35. The high strength electrical connector of claim 26, wherein said the connecting end portion of said cable strength member includes an enlarged retaining member disposed within the said overmold portion and securely attached to said cable strength member.

36. The high strength electrical connector of claim 26, wherein said second inner recessed end portion of said coupling nut includes a radially expanded portion adapted to receive said overmold portion for preventing axial movement of said overmold portion within said coupling nut for more securely connecting said first and second electrical cables.

37. The high strength electrical connector of claim 36, wherein said radially expanded portion is in the form of an annular ring disposed about said second opposed inner recessed end portion.

38. The high strength electrical connector of claim 26, wherein said overmold portion includes a smooth outer surface engaging the second opposed inner end portion of said coupling nut for allowing said coupling nut to freely rotate on said overmold portion.

39. A high strength electrical connector of claim 26, further comprising:

an anti-vibration member disposed between and engaging said overmold portion and the second opposed inner end portion of said coupling nut for allowing rotation of said coupling nut on said mating receptacle assembly in a first direction for connecting said first and second electrical leads, while inhibiting rotation between said mating receptacle assembly and said coupling nut in a second opposed direction in disconnecting said first and second electrical leads.

40. The high strength electrical connector of claim 39, wherein the second opposed inner recessed end portion of said coupling nut includes a generally circular undulating surface and said anti-vibration member is in the general form of a disk having a first surface with plural deformable, resilient fingers engaging said undulating surface, and wherein said fingers are adapted to bend when said coupling nut is rotated in said first direction on said mating receptacle assembly and wherein said fingers engage said undulating surface in a manner which inhibits rotation of said coupling nut on said mating receptacle assembly when rotated in said second opposed direction.

41. The high strength electrical connector of claim 40, wherein said anti-vibration member includes a second opposed surface having plural spaced engaging member extending therefrom, and wherein said engaging members engage in end of said overmold portion and prevent rotation of said anti-vibration member relative to said first electrical cable.

42. The high strength electrical connector of claim 41, wherein each of said deformable, resilient fingers is aligned generally perpendicular to the axis of rotation of the mating receptacle assembly.

43. The high strength electrical connector of claim 41, wherein said fingers are arranged in a spaced manner on said first surface and adjacent in outer periphery of said anti-vibration member.

44. The high strength electrical connector of claim 43, wherein said anti-vibration member includes first and second deformable, resilient fingers disposed on its first surface adjacent an outer periphery thereof and displaced 180° from one another on said disk-shaped anti-vibration member.

45. The high strength electrical connector of claim 26, wherein said second inner recessed end portion of said coupling nut includes a radially expanded portion adapted to receive said outer overmold portion for preventing axial movement of said inner and outer overmold portions within said coupling nut for more securely connecting said first and second electrical cables.

46. The high strength electrical connector of claim 45, wherein said radially expanded portion is in the form of an annular ring disposed about said second opposed inner recessed end portion.

47. The high strength electrical connector of claim 26, wherein said overmold portion includes a smooth outer surface engaging the second opposed inner end portion of said coupling nut for allowing said coupling nut to freely rotate on said overmold portion.

* * * * *